US006116602A

United States Patent [19]

McLoy

[11] Patent Number: 6,116,602

[45] Date of Patent: Sep. 12, 2000

[54] ENHANCED FOUR HANDED VARIATION OF CHESS

[76] Inventor: Mackie C McLoy, 7722 Crestmont Ave., Newark, Calif. 94560-1520

[21] Appl. No.: 09/229,149

[22] Filed: Jan. 12, 1999

[51] Int. Cl.[7] ..... A63F 3/02

[52] U.S. Cl. ..... 273/261; 273/260

[58] Field of Search ..... 273/236, 242, 273/260, 287, 261

[56] References Cited

U.S. PATENT DOCUMENTS

| | | |
|---|---|---|
| 3,843,130 | 10/1974 | Whitney . |
| 4,067,578 | 1/1978 | Chang . |
| 4,147,360 | 4/1979 | Bailey . |
| 4,708,349 | 11/1987 | Shomer . |
| 4,778,187 | 10/1988 | Deak . |
| 4,932,669 | 6/1990 | Perry . |
| 5,125,666 | 6/1992 | Adams . |
| 5,511,793 | 4/1996 | Watt . |
| 5,662,329 | 9/1997 | Nason . |
| 5,690,334 | 11/1997 | Duke . |
| 5,692,754 | 12/1997 | Rostami . |

OTHER PUBLICATIONS

Chess Variations 1968 John Gollon pp. 203–206 219–221 Charles E. Tuttle Co, : Publishers, Rutland, VT.

Dictionary of Modern Chess 1972 Byrne J. Horton pp. 75–76 2nd Printing, The Citadel Press, Secaucus, NJ.

*Primary Examiner*—Jeanette Chapman
*Assistant Examiner*—Vishu Mendiratta

[57] ABSTRACT

A four handed chess-type board game played on a 228 square board consisting of a 10×10, 100 square central playing area with four 32 square extensions consisting of two 1×10 rows and one 1×12 row on the outermost edge. 88 playing pieces are used and include: the standard knight, bishop, rook, queen, an enhanced king and pawn, and four new pieces called the archbishop, chancellor, wizard, and dragon. In team play, the object is to pin one opposing king and to checkmate the other opposing king. In individual play, the object is to eliminate two of the opposing kings and to checkmate the last opposing king.

8 Claims, 6 Drawing Sheets

ENHANCED FOUR HANDED VARIATION OF CHESS

CROSS-REFERENCE TO RELATED APPLICATIONS

Not Applicable

STATEMENT REGARDING FEDERALLY SPONSORED RESEARCH AND DEVELOPMENT

Not Applicable

REFERENCE TO MICROFICHE APPENDIX

Not Applicable

BACKGROUND OF THE INVENTION

1. Field of the Invention

The invention relates to chess-type games.

2. Description of Prior Art

Chess is an ancient board game played throughout the world. It consists of two players maneuvering his/her own set of playing pieces consisting of eight pawns, two knights, two bishops, two rooks, one queen, and one king on an 8×8 checkerboard. The object of the game is to checkmate the opposing player. Competitions range from casual family grudge matches to international competitions.

Various new pieces have been introduced throughout the years. H. E. Bird developed a chess game with the addition of two new pieces: the chancellor which is a combination of the knight and the rook; the archbishop which is a combination of the knight and the bishop. The new pieces were placed beside the king and the queen. Roughly fifty years later, Capablanca created a game with the same pieces, but placed the new pieces between the bishops and the knights. U.S. Pat. No. 5,511,793, U.S. Pat. No. 5,690,334, and U.S. Pat. No. 5,692,754 also incorporate the use of several new pieces. These are all successful in sparking interest by mixing new and traditional pieces while staying as close to the standard rules of chess as possible.

In an effort to involve more players, various expanded boards with a plurality of pieces have been created. Double Chess and Frere's Four-Handed Chess are very similar in that they use two sets of standard chess pieces and are played on an 8×8 board with four 3×8 extensions on the sides. The only major difference is that in Frere's game the partner takes control of his/her checkmated partner's pieces whereas in Double Chess, the partner's turn is skipped. U.S. Pat. No. 4,932,669 uses the same board and pieces but adds a new option for pawn advancement. U.S. Pat. No. 4,778,187 uses a similar pawn variant but is played on a larger board (the extensions are 4×8). U.S. Pat. No. 4,067,578 uses the same larger board and has the central playing area further subdivided by two diagonal lines. U.S. Pat. No. 5,125,666 uses an 8×8 board with four 2×8 extensions and two sets of standard chess pieces while U.S. Pat. No. 3,843,130 goes one step further by adding two squares to each extension and placing two additional knights on those squares. U.S. Pat. No. 4,708,349 uses two sets of a standard chess set and is played on a 12×12 board with four 2×8 extensions. U.S. Pat. No. 4,147,360 uses a 10×l0 central playing which is subdivided by two diagonal lines and has four 4×10 extensions on each side; furthermore, it has two new additional pieces.

Many new variations of chess have been invented which have new pieces or allow for more social interest and interaction by the addition of multiple player possibilities. The problem with a two player chess game expanded by the addition of new playing pieces is that the game is too similar to standard chess, which has remained the same for hundreds of years. The same problem exists with multiple player chess games which use a plurality of standard chess pieces on an expanded board. Furthermore, the expanded playing area is simply too large for the range of most of the standard playing pieces; One of the reasons chess has remained same for such a long time is that the abilities of the pieces work well within the limits of the board.

SUMMARY OF THE INVENTION

The invention provides a four handed chess-type game with two enhanced standard pieces and four new powerful pieces. The game board consists of a 100 square central playing area and four 32 square extensions. The pieces available for each player include the standard knight, bishop, rook, and queen. The abilities of the king and pawn have been increased. The addition of the archbishop, chancellor, wizard, and dragon further enhance the game.

The present invention is an improvement over prior art games in that it adds new dimensions as well as new elements to the traditional strategy game of chess. First of all, it keeps with the original spirit of the game by using the elements of the checkerboard and the original pieces. In addition, it adds the possibility of multiple players by expanding the playing area and increasing the number of pieces. And it adds new playing pieces which relate to standard piece movements and allow play to flow on the larger board. Moreover, the art of using pieces in conjunction to attack an opponent is enhanced by team play.

DESCRIPTION OF THE DRAWINGS

The pawn is identified by the letter "P" in FIG. 1A, FIG. 1B, and FIG. 2.

The bishop is identified by the letter "B" in FIG. 1A, FIG. 1B, and FIG. 3.

Figure 1A:
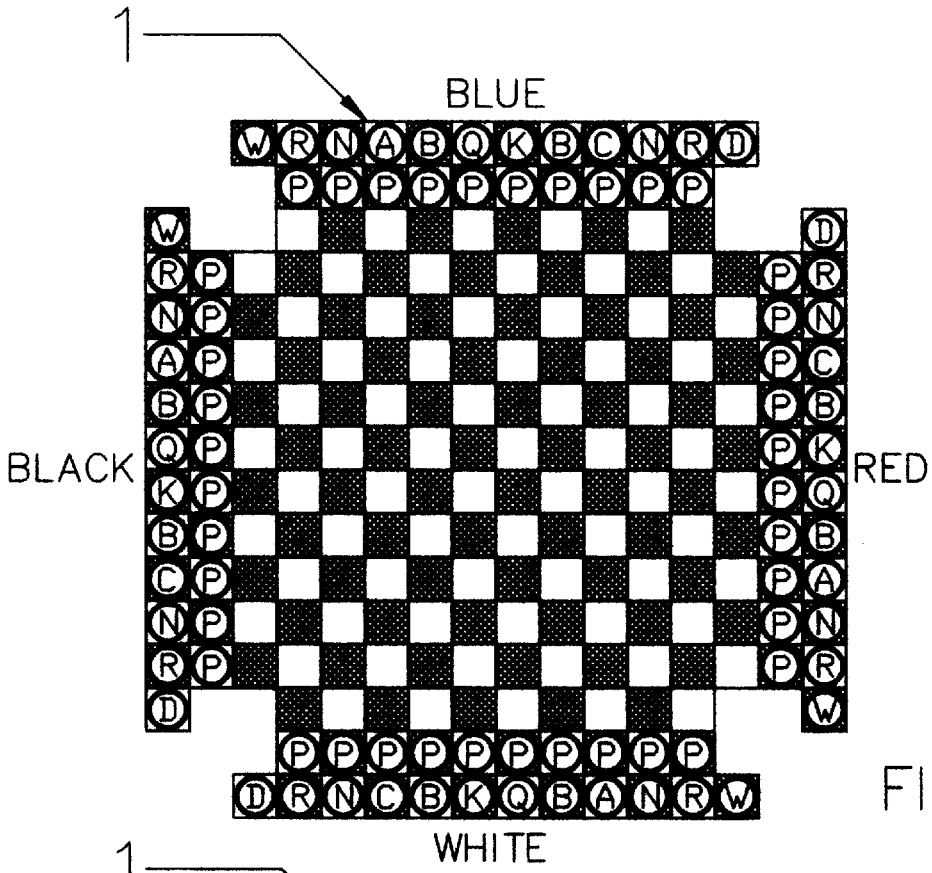
Figure 1B:
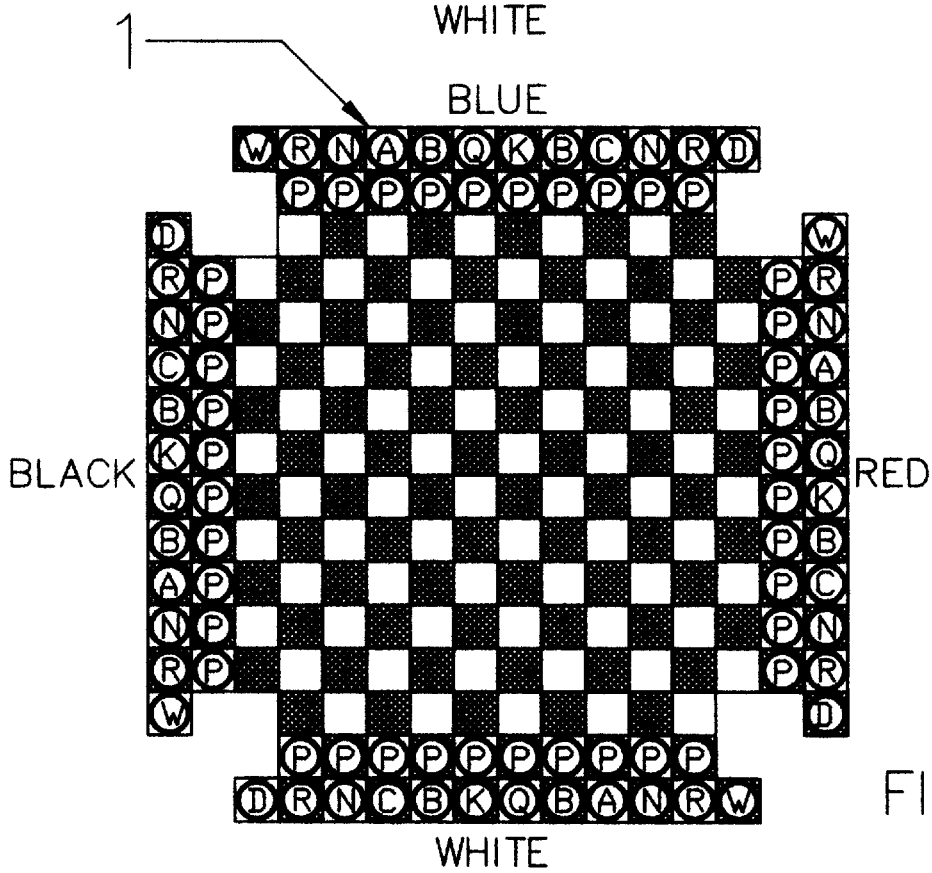
Figure 4:
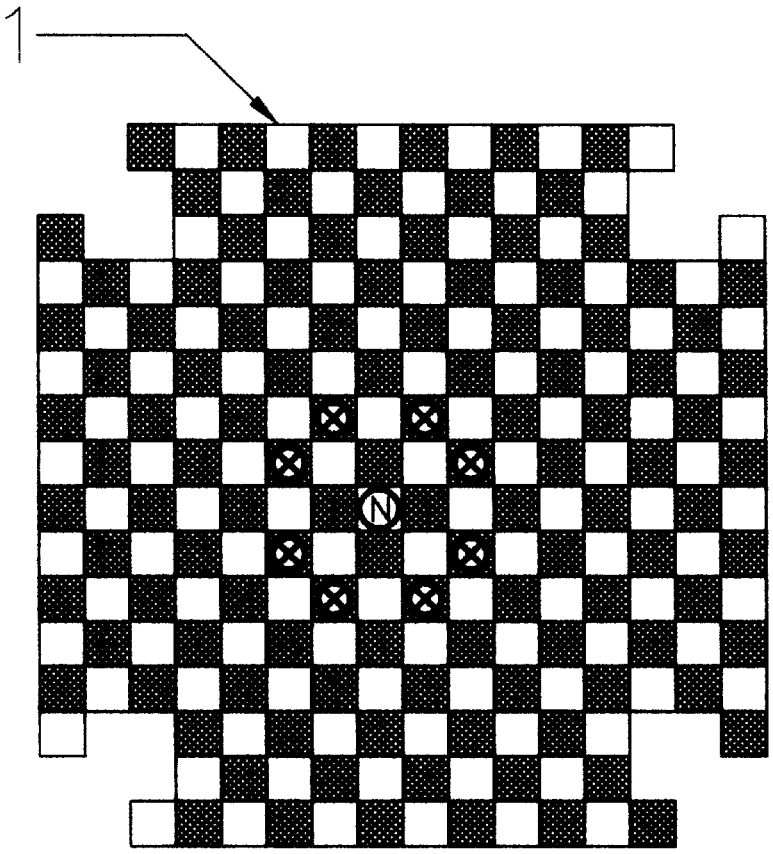

The knight is identified by the letter "N" in FIG. 1A, FIG. 1B, and FIG. 4.

The rook is identified by the letter "R" in FIG. 1A, FIG. 1B, FIG. 5, and FIG. 9.

Figure 6:
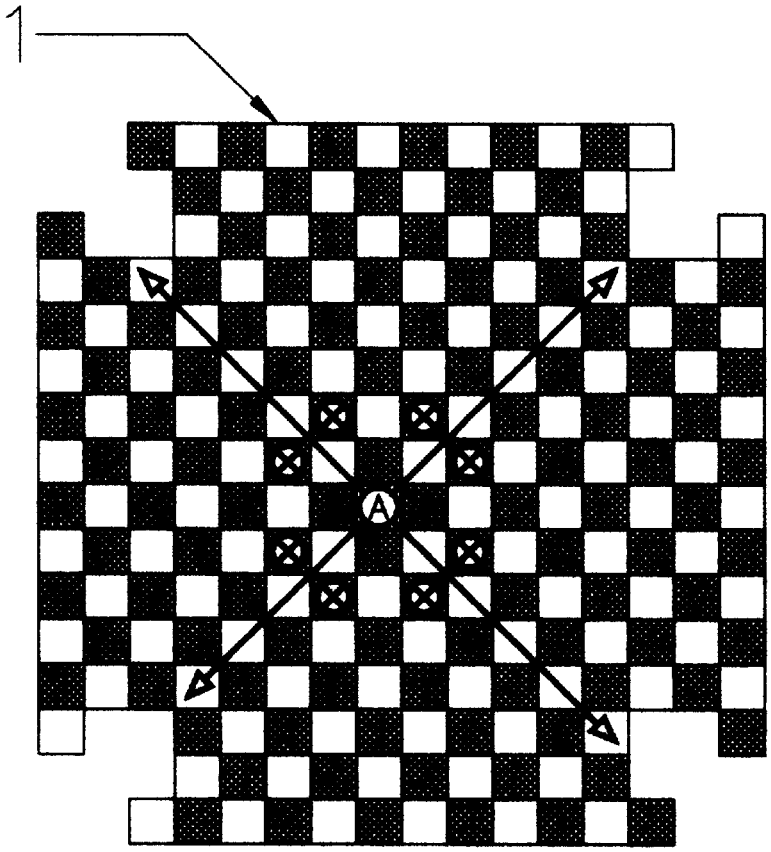

The archbishop is identified by the letter "A" in FIG. 1A, FIG. 1B, and FIG. 6.

Figure 7:
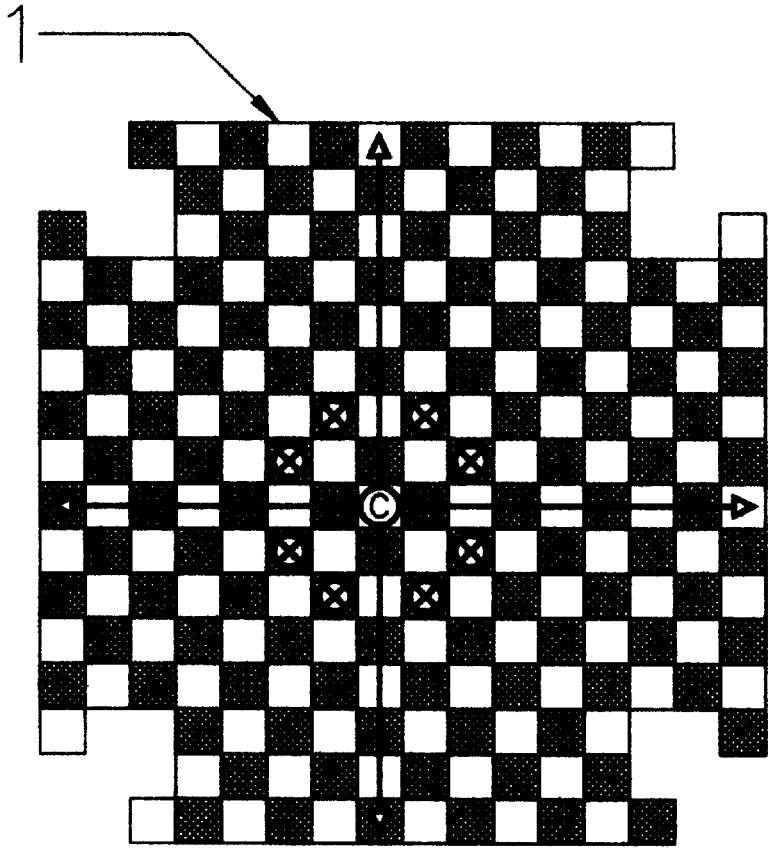

The chancellor is identified by the letter "C" in FIG. 1A, FIG. 1B, and FIG. 7.

Figure 8:
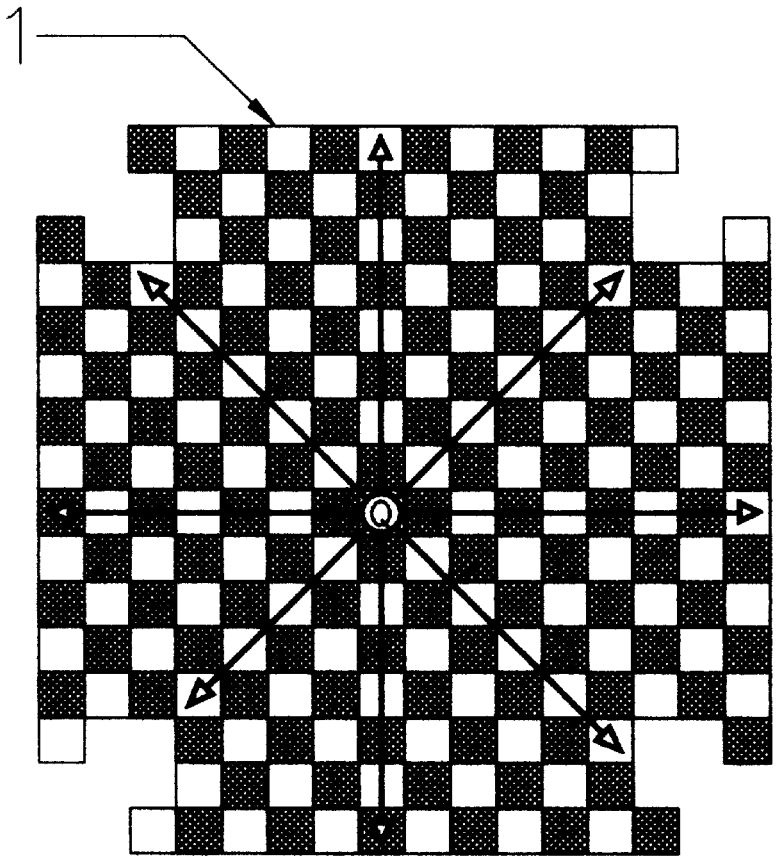

The queen is identified by the letter "Q" in FIG. 1A, FIG. 1B, and FIG. 8.

Figure 9:
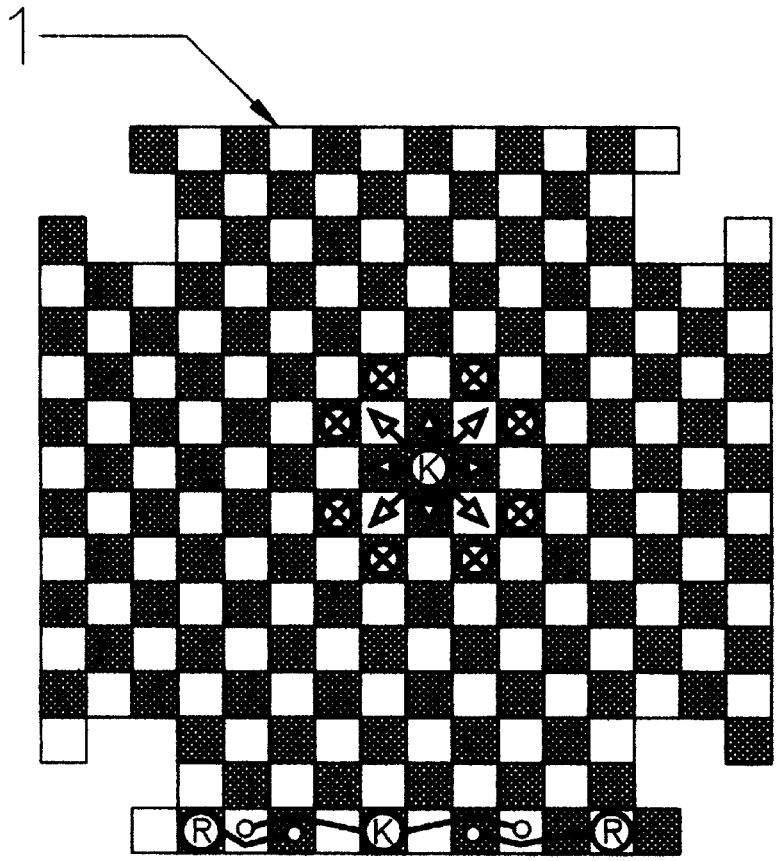

The king is identified by the letter "K" in FIG. 1A, FIG. 1B, and FIG. 9.

Figure 10:
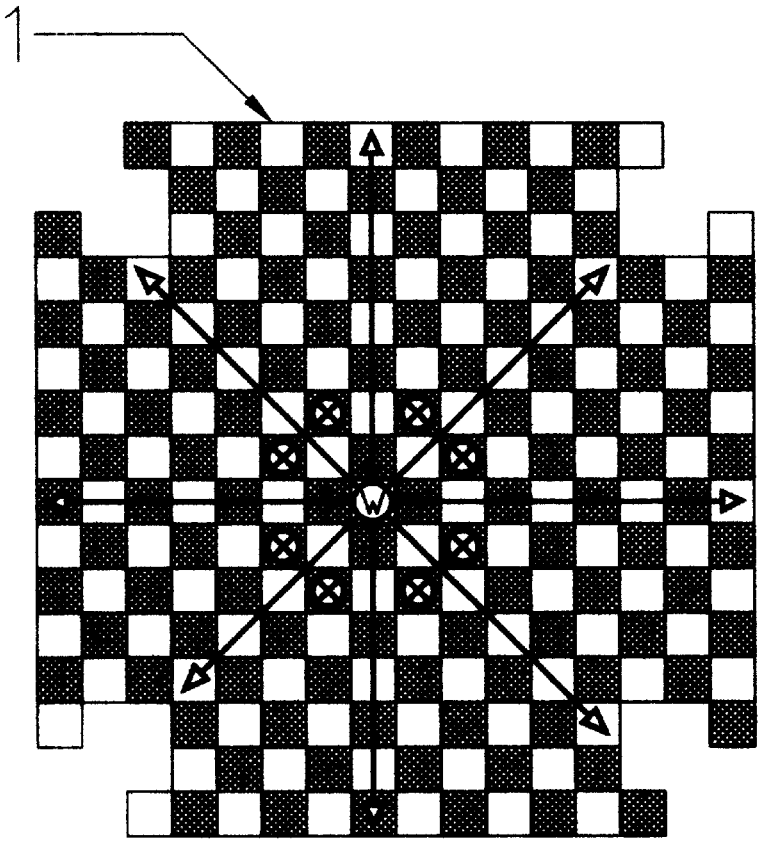

The wizard is identified by the letter "W" in FIG. 1A, FIG. 1B, and FIG. 10.

Figure 11:
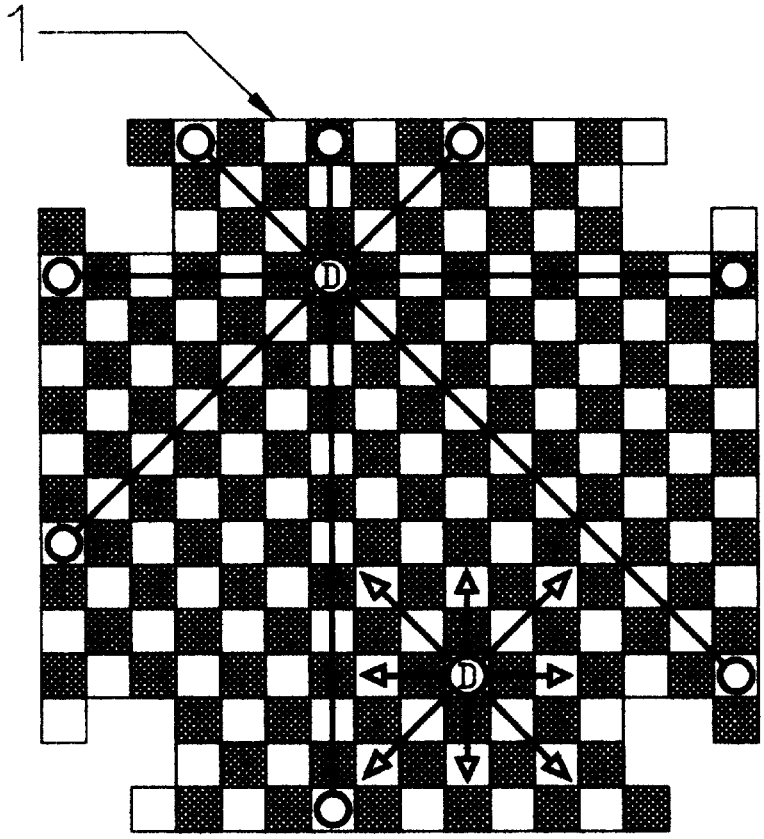

The dragon is identified by the letter "D" in FIG. 1A, FIG. 1B, and FIG. 11.

FIG. 1A is a plan view of the game board 1 with the pieces in their starting positions for team play.

FIG. 1B is a plan view of the game board 1 with the pieces in their starting positions for individual play.

Figure 2:
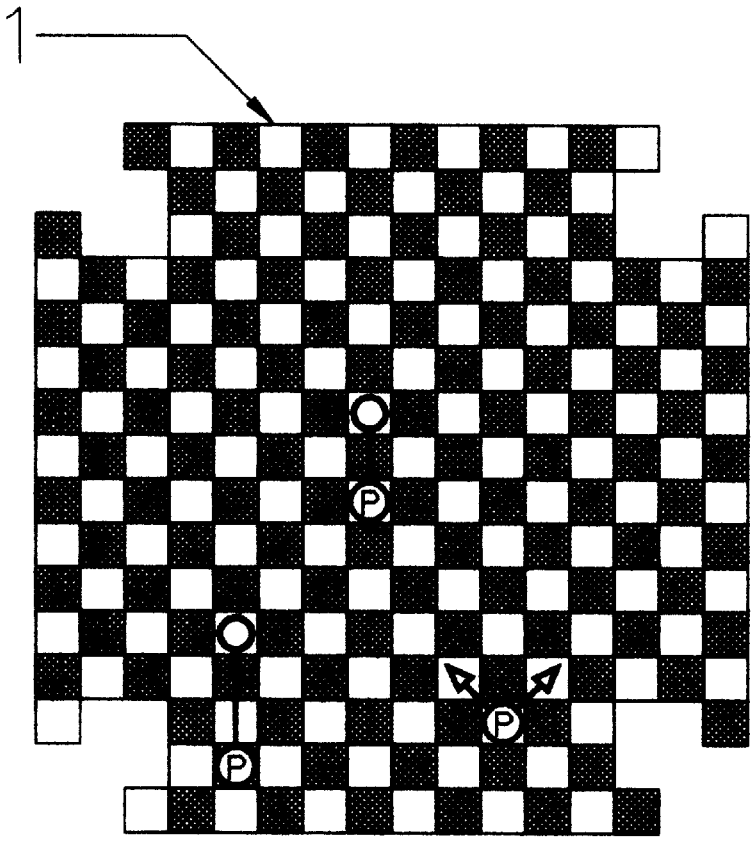

FIG. 2 is a plan view of the pawn's movement and capturing ability on the game board 1.

Figure 3:
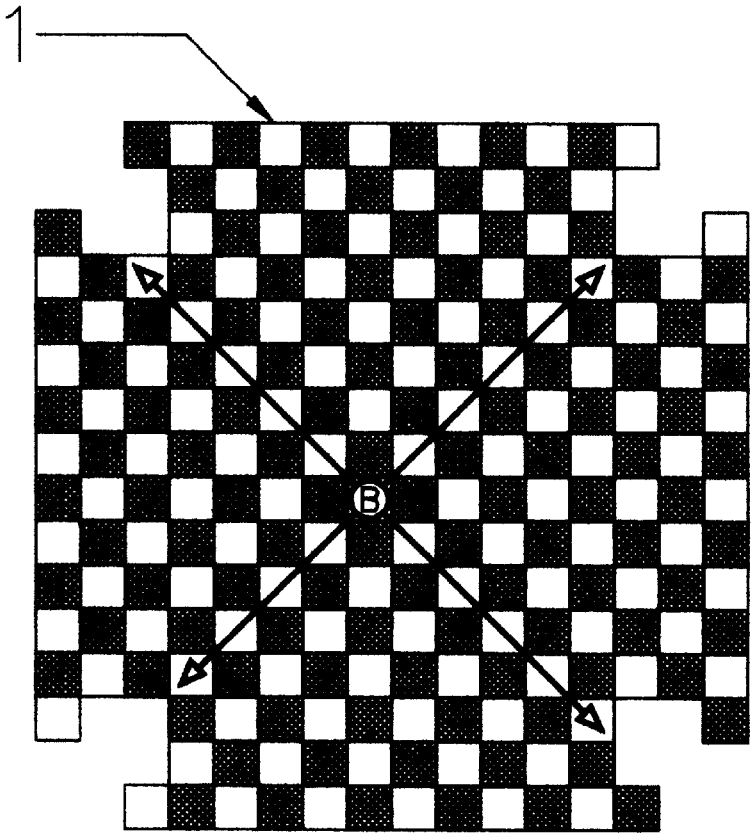

FIG. 3 is a plan view of the bishop's movement and capturing ability on the game board 1.

FIG. 4 is a plan view of the knight's movement and capturing ability on the game board 1.

Figure 5:
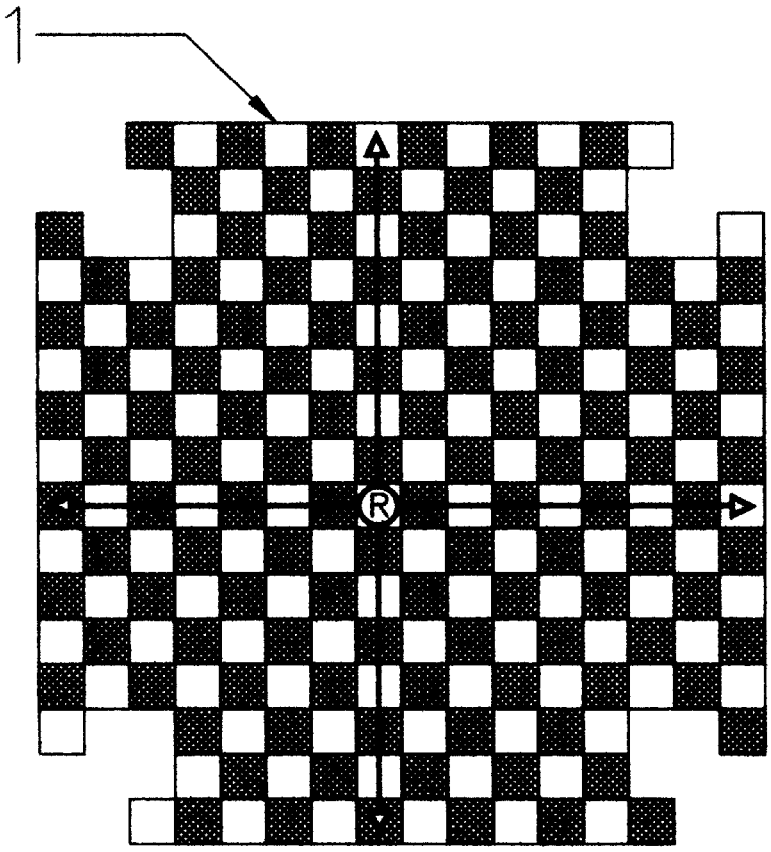

FIG. 5 is a plan view of the rook's movement and capturing ability on the game board 1.

FIG. 6 is a plan view of the archbishop's movement and capturing ability on the game board 1.

FIG. 7 is a plan view of the chancellor's movement and capturing ability on the game board 1.

FIG. 8 is a plan view of the queen's movement and capturing ability on the game board 1.

FIG. 9 is a plan view of the king's movement, capturing, and castling ability on the game board 1.

FIG. 10 is a plan view of the wizard's movement and capturing ability on the game board 1.

FIG. 11 is a plan view of the dragon's movement and capturing ability on the game board 1.

DESCRIPTION OF THE PREFERRED EMBODIMENTS

The illustration of the board and pieces is for the purpose of description and not of the limitations to be placed upon the invention.

I. GAMEBOARD

The new variation of chess features a game board 1 and four sets of 22 playing pieces. The game board 1 consists of 228 squares of contrasting colors set in a checkerboard fashion as shown in FIG. 1A and FIG. 1B.

II. GAME PIECES

Each set of 22 pieces is set on the board (at the start of the game) as shown in FIG. 1A and FIG. 1B. Each individual set contains: ten pawns which have extended moves, two bishops, two knights, two rooks, one queen, one new version of a king, one new piece called an archbishop, one new piece called a chancellor, one new piece called a wizard, and one new piece called a dragon. Bishops, rooks, knights, and the queen move and capture as in standard chess. Pawns capture as in standard chess but may move forward one or two squares; furthermore, a pawn may move forward one, two, or three squares on its initial move. If the pawn reaches the first rank of any of the opposing players, it is promoted to any piece other than a king or a pawn regardless of what pieces are still on the board. The king has the same movement, capture, and restriction as in standard chess. In addition, a king may also move as a knight providing that it is not in check. Furthermore, the king is restricted from moving within a knight's move of an opposing king. Castling is the same except the king moves three instead of two spaces toward the side that it is castling. The archbishop may move and capture as the knight or the bishop. The chancellor may move and capture as the knight or the rook. The wizard may move and capture as the knight, the bishop, or the rook. The dragon may move to any vacant square orthogonal or diagonal within the area of the game board 1 regardless of any pieces that are in its direct path; the dragon may capture opposing pieces that are within one or two squares orthogonal or diagonal from its position (the dragon may not 'jump' when capturing).

III. RULES FOR TEAM PLAY

For team play, white and black play against blue and red. The order of play starts with white, passes across to blue, then to the right with black, continues across to red, and back to the top of the order. The opening position for team play is shown in FIG. 1A. If there are only three players, one will play as white and black; the other two will play as blue and red. If there are only two players, one will play as white and black; the other will play as blue and red. The object of the game is to pin one of the opposing kings and to checkmate the other opposing king.

A king is placed in check when an opposing player's piece moves into a position that has the king in capturing range. When the king lacks the ability to get out of check (ex. moving to a safe square, capturing the enemy piece, or blocking the attack of the enemy piece), it is pinned or checkmated. Although it is not recommended, players are allowed to move pieces which expose his/her allied king to check. Furthermore, allied pieces do not place allied kings in check.

A double check is a situation when a king is placed in check by both members of the opposing team before the before the player's turn. In this situation, the king must be moved out of both checks; if it can not be moved, the king is then pinned or checkmated.

When only one team member is checkmated, it is called a pin. All of the player's pieces lose the ability to move, attack, or control any squares when a player is in the pin situation. Thus the pinned player's turn is skipped, and his/her ally is faced with two attacks to one defense. A pin can last the duration of the game depending on what the allied partner does to remedy the situation. A player gets the allied king out of a pin by capturing the piece which holds the king pinned, blocking the enemies pinning piece, pinning one of the enemy kings which is holding the allied king in pin (a pinned player's pieces do not control squares; therefore, they can not hold a king in check). A king is also out of a pin if the enemy withdraws from the pinning situation or if the pin is blocked by another enemy piece. In order for a king to be checkmated, the allied king must first be pinned.

It is a stalemate if a king is on a safe square, is unable to move without getting into check, and can not move any other piece(s).

A game is won when a team pins one king and checkmates the other king or if one of the opposing players resigns. A game is a draw if a stalemate occurs or if both teams agree to end the game.

IV. RULES FOR INDIVIDUAL PLAY

For individual play, the order of play starts with white and passes clockwise to black, blue and red. The opening position for individual play is shown in FIG. 1B. The object of the game is to checkmate the last opposing king after the other two opposing kings have been checkmated. Example: white checkmates blue and black but is in turn checkmated by red. Red is declared the winner. Thus, a player can win the game by checkmating the final opponent.

The rules of check apply the same as in team play except all other colors can place a king in check. The difference is that when a player is checkmated, all of the player's pieces are removed from the board and play resumes with the remaining colors. Double check is further expanded to include triple check. The rules of stalemate are the same as in team play.

A game is won when an individual checkmates the last opposing king or if one of the opposing players resigns. A game is a draw if a stalemate occurs or if both teams agree to end the game.

I claim as my invention:

1. A four handed chess-type game apparatus which comprises of:

A) a game board consisting of:
1) 228 squares arranged in a contrasting checkerboard fashion;
2) a 10×10, 100 square central playing area with four 32 square extensions consisting of: two 1×10 square rows and one 1×12 square row on the outermost edge;

B) 88 total pieces divided into four individual and contrasting sets of 22 playing pieces each containing:
1) seven pieces, which have the standard movement and capturing procedures as, used in chess including:
a) two bishops,
b) two knights,
c) two rooks,
d) and one queen;
2) ten pawns,
a) which may capture as in standard chess,
b) may move forward one or two squares,
c) may move forward one, two, or three squares on its initial move,
d) may be promoted at the first rank of the opposing player(s) to any piece other than a king or another pawn;
3) one king,
a) which has the movement, capturing, and restrictions as in chess,
b) in addition, the king may move and capture as a knight, except when it is in check,
c) castling is the same as in chess except the king moves three instead of two squares toward the side which it is castling,
d) the king is further restricted from moving within range of the knight type move of an opposing king;
4) one archbishop,
a) which may move and capture as the knight or the bishop;
5) one chancellor,
a) which may move and capture as the knight or the rook;
6) one wizard,
a) which may move and capture as the knight, bishop, or rook;
7) one dragon,
a) which may move to any vacant square orthogonal or diagonal within the area of the board regardless of what pieces are in the direct path,
b) the dragon may capture opposing pieces which are one or two squares orthogonal or diagonal but may not 'jump' when capturing.

2. Method of playing a chess-type game whereas:

A) 88 total pieces are divided into four individual and contrasting sets of 22 playing pieces each containing:
1) seven pieces that have the standard movement and capturing procedures as used in chess including:
a) two bishops,
b) two knights,
c) two rooks,
d) and one queen;
2) ten pawns,
a) which may capture as in standard chess,
b) may move forward one or two squares,
c) may move forward one, two, or three squares on its initial move,
d) may be promoted at the first rank of the opposing player(s) to any piece other than a king or another pawn;
3) one king,
a) which has the movement, capturing, and restrictions as in chess,
b) in addition, the king may move and capture as a knight except when it is in check,
c) castling is the same as in chess except the king moves three instead of two squares toward the side which it is castling,
d) the king is further restricted from moving within range of the knight type move of an opposing king;
4) one archbishop,
a) which may move and capture as the knight or the bishop;
5) one chancellor,
a) which may move and capture as the knight or the rook;
6) one wizard,
a) which may move and capture as the knight, bishop, or rook;
7) one dragon,
a) which may move to any vacant square orthogonal or diagonal within the area of the board regardless of what pieces are in the direct path,
b) the dragon may capture opposing pieces which are one or two squares orthogonal or diagonal but may not 'jump' when capturing;

B) said pieces are placed on a game board consisting of:
1) 228 squares arranged in a contrasting checkerboard fashion;
2) a 10×10, 100 square central playing area with four 32 square extensions consisting of: two 1×10 square rows and one 1×12 square row on the outermost edge;

C) players alternate turns by moving and/or capturing one piece per turn; whereas each of the four hands gets one turn per round,
1) moving involves occupying an empty square within the range of the pieces ability,
a) except for the dragon and knight type moves, all movement is restricted to a direct path,
b) all movement is restricted to the boundaries of the playing area;
2) capturing involves moving to a square occupied by an enemy piece and removing the enemy piece from the playing area,
a) except for the knight type move, all capturing is restricted to a direct path,
b) note: the pawn's capture is different from the pawn's move,
c) note: the dragon's capture is different from the dragon's move,
d) a king is placed in check when an opposing player's piece moves into a position that has the king in capturing range,
1} when the king lacks the ability to get out of check; it is checkmated.

3. Method of claim 2 whereas:

A) for team play, the starting position of said playing pieces is as follows:
1) the first set of playing pieces,
a) are set on the two outer rows starting from the left with light squares and ending on the right with dark squares,
b) on the outermost row of twelve squares from the left to the right in the sequence: dragon, rook, knight, chancellor, bishop, king, queen, bishop, archbishop, knight, rook, wizard, c) the ten pawns are positioned on the next adjacent row of ten squares;

2) the second set of playing pieces, a) are set directly across from the first set of playing pieces, b) are set on the two outer rows starting from the left with light squares and ending on the right with dark squares, c) on the outermost row of twelve squares from left to right in the sequence: dragon, rook, knight, chancellor, bishop, king, queen, bishop, archbishop, knight, rook, wizard, d) the ten pawns are positioned on the next adjacent row of ten squares;

3) the third set of playing pieces, a) are set to the right of the second set of playing pieces, b) are set on the two outer rows starting from the left with dark squares and ending on the right with light squares, c) on the outermost row of twelve squares from left to right in the sequence: wizard, rook, knight, archbishop, bishop, queen, king, bishop, chancellor, knight, rook, dragon, d) the ten pawns are positioned on the next adjacent row of ten squares;

4) the fourth set of playing pieces, a) are set across from the third set of playing pieces, b) are set on the two outer rows starting from the left with dark squares and ending on the right with light squares, c) on the outermost row of twelve squares from left to right in the sequence: wizard, rook, knight, archbishop, bishop, queen, king, bishop, chancellor, knight, rook, dragon, d) the ten pawns are positioned on the next adjacent row of ten squares;

B) players take turns manipulating said pieces, 1) according to the procedures described, 2) and in the order that the pieces are placed, 3) allied pieces do not place allied kings in check;

C) ending the game, 1) winning the game, a) by pinning and checkmating the opposing kings, b) or if the opposing player(s) resigns;

2) ending the game in draw, a) by stalemating one of the opposing kings, b) or if both teams agree to end the game.

4. Method of claim 3 whereas:

A) a pin situation states:

1) if only one king is checkmated, it is pinned, 2) a pinned player's pieces lose the ability to move, attack, or control any squares, 3) a pinned player's turn is skipped until it is relieved of the pin situation.

5. Method of claim 3 whereas:

A) a stalemate occurs if, 1) a king is on a safe square, 2) is unable to move without getting into check, 3) and can not move any other piece.

6. Method of claim 2 whereas:

A) for individual play, the starting position of said playing pieces is as follows:

1) the first set of playing pieces a) are set on the two outer rows starting from the left with light squares and ending on the right with dark squares, b) on the outermost row of twelve squares from left to right in the sequence: dragon, rook, knight, chancellor, bishop, king, queen, bishop, archbishop, knight, rook, wizard, c) the ten pawns are positioned on the next adjacent row of ten squares;

2) the second set of playing pieces, a) are set to the left of the first set of playing pieces, b) are set on the two outer rows starting from the left with dark squares and ending on the right with light squares, c) on the outermost row of twelve squares from left to right in the sequence: dragon, rook, knight, chancellor, bishop, king, queen, bishop, archbishop, knight, rook, wizard, d) the ten pawns are positioned on the next adjacent row of ten squares;

3) the third set of playing pieces, a) are set to the left of the second set of playing pieces, b) are set on the two outer rows starting from the left with light squares and ending on the right with dark squares, c) on the outermost row of twelve squares from left to right in the sequence: dragon, rook, knight, chancellor, bishop, king, queen, bishop, archbishop, knight, rook, wizard, d) the ten pawns are positioned on the next adjacent row of ten squares;

4) the fourth set of playing pieces, a) are set to the left of the third set of playing pieces, b) are set on the two outer rows starting from the left with dark squares and ending on the right with light squares, c) on the outermost row of twelve squares from left to right in the sequence: dragon, rook, knight, chancellor, bishop, king, queen, bishop, archbishop, knight, rook, wizard, d) the ten pawns are positioned on the next adjacent row of ten squares;

B) players take turns manipulating said pieces, 1) according to the procedures described, 2) and in the order that the pieces are placed;

C) ending the game, 1) winning the game, a) by checkmating the last opposing king after the other two opposing kings have been checkmated, b) or if the opposing player(s) resigns;

2) ending the game in a draw, a) by stalemating one of the opposing kings, b) or if all players agree to end the game.

7. Method of claim 6 whereas:

A) when a king is checkmated, 1) all of the checkmated player's pieces are removed from the game board.

8. Method of claim 6 whereas:

A) a stalemate occurs if, 1) a king is on a safe square, 2) is unable to move without getting into check, 3) and can not move any other pieces.

* * * * *